United States Patent [19]

Pollet et al.

[11] B 4,013,471

[45] Mar. 22, 1977

[54] DEVELOPMENT OF PHOTOGRAPHIC SILVER HALIDE ELEMENTS

[75] Inventors: Robert Joseph Pollet, Vremde; Camille Angelina Vandeputte, Mortsel; Francis Jeanne Sels, Kontich; Gerard Laurens Vanreusel, Hove; Jozef Frans Willems, Wilrijk; George Frans van Veelen, Mortsel, all of Belgium

[73] Assignee: AGFA-GEVAERT N.V., Mortsel, Belgium

[22] Filed: Nov. 20, 1973

[21] Appl. No.: 417,498

[44] Published under the second Trial Voluntary Protest Program on March 23, 1976 as document No. B 417,498.

[30] Foreign Application Priority Data

Dec. 7, 1972 United Kingdom ..... 56630/72

[52] U.S. Cl. ..... 96/66.3; 96/66 R; 96/95; 96/107; 96/114

[51] Int. Cl.[2] ..... G03C 5/30; G03C 1/72; G03C 1/28; G03C 1/06

[58] Field of Search ..... 96/66, 66.3, 114 R, 96/95, 107

[56] References Cited

UNITED STATES PATENTS

| | | | |
|---|---|---|---|
| 3,046,129 | 7/1962 | Graham et al. | 96/66.3 |
| 3,046,133 | 7/1962 | Minsk | 96/114 |

FOREIGN PATENTS OR APPLICATIONS

| | | | |
|---|---|---|---|
| 1,494,509 | 9/1967 | France | 96/66 R |

*Primary Examiner*—Mary F. Kelley
*Attorney, Agent, or Firm*—A. W. Breiner

[57] ABSTRACT

Polyoxyethylene compounds carrying thioether groups as substituents on the linear chain are described for accelerating or activating development of exposed silver halide elements.

22 Claims, No Drawings

DEVELOPMENT OF PHOTOGRAPHIC SILVER HALIDE ELEMENTS

The present invention relates to silver halide photography, and more particularly, to the development of photographic silver halide elements in the presence of compounds promoting the development.

It is known to increase the sensitivity of photographic emulsions by addition of chemical sensitizers e.g. sulphur-containing compounds, reducing agents and salts of gold or other noble metals or combinations of these compounds. Such chemical sensitizers are believed to react with the silver halide to form, on the surface of the silver halide, minute amounts of silver sulphide or of silver or of other noble metals which increases the sensitivity of the silver halide emulsion. This kind of chemical sensitization, however, reaches a limit beyond which further addition of sensitizer or further digestion with the sensitizer merely increases the fog of the emulsion with constant or decreasing speed.

As is known in the art, further increasing of the speed of the photographic reproduction system can be effected by the presence during development of alkylene oxide polymers, e.g. polyoxyethylene compounds, thioether compounds and/or onium or polyonium compounds of the ammonium, phosphonium or sulphonium type. These compounds sensitize the emulsion by development acceleration and may be used either in the emulsion or the developer.

We have now found that development of exposed silver halide emulsions can be accelerated or activated by the presence during development of a polyoxyethylene compound wherein the polyoxyethylene compound carries thioether groups as substituents on the linear chain and wherein some or all of the thioether sulphur atoms may have been converted into ternary sulphonium salt groups. By compounds comprising thioether groups is meant that the compounds comprise sulphur atoms in the form of thioether linkages i.e. divalent sulphur atoms which are joined to two carbon atoms.

The compounds of the present invention may be used for various kinds of photographic silver halide elements. They can be used in the black-and-white development as well as the colour development of photographic silver halide elements. In addition to be useful for negative processing they may also be used for reversal processing.

The present invention thus provides a method of developing a photographic element containing developable silver halide in the presence of a polyoxyethylene compound wherein the polyoxyethylene compound carries thioether groups as substituents on the linear chain, and wherein some or all of the thioether sulphur atoms may have been converted into ternary sulphonium salt groups.

Particularly suitable polyoxyethylene compounds with thioether side chains, are compounds comprising recurring units of the following formula:

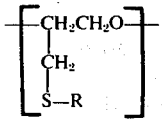

wherein R represents an aliphatic, carbocyclic aromatic or heterocyclic group which may carry one or more substituents e.g. alkyl, aralkyl, hydroxyalkyl, alkoxyalkyl, alkylthioalkyl, acyloxyalkyl, the alkyl groups preferably carrying at most 5 C-atoms, cycloalkyl e.g. cyclohexyl aryl e.g. phenyl and phenyl substituted with alkyl, alkoxy, akylthio, etc.

The compounds for use in accordance with the present invention can be derived from polyepihalohydrins e.g. polyepichlorohydrin and polyepibromohydrin including ethers and esters thereof by reaction with aliphatic, carbocyclic aromatic, or heterocyclic mercaptides. Apart from the recurring units with thioether group in the side chain, the polyoxyalkylene compounds may also comprise unreacted epihalohydrin units obtained by incomplete conversion of the polyepihalohydrin. It is preferred, however, to have at least 20 mole % of randomly distributed recurring units of the above formula.

In the preparation of the polyoxyethylene compounds, the molecular weight of the polyepihalohydrins, ethers or esters thereof may vary within wide limits. Dimeric compounds may be used as well as commercially available polyepihalohydrins which possess generally a molecular weight of at most 3000. However, polyepihalohydrins of higher molecular weight, as described in Jl. Polymer Sci. 40 (1959) p. 571, may also be employed.

PREPARATION 1

To a solution of 73.6 g of sodium in 1.5 liter of anhydrous ethanol, 250 g of 2-mercaptoethanol were added at room temperature. After addition of a solution of 320 g of polyepichlorohydrin (molecular weight: 1000) in 700 ml of ethanol, the mixture was refluxed for 7 hours. The mixture was cooled to room temperature and the precipitate of sodium chloride was filtered off by suction. The filtrate was concentrated by evaporation until dry to yield 446 g of polymeric compound comprising about 100 mole % of recurring units of the formula:

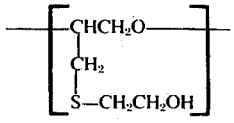

PREPARATION 2

To a solution of 5.75 g of sodium in 200 ml of anhydrous ethanol, 19.5 g of 2-mercaptoethanol were added at room temperature. After addition of a solution of 50 g of polyepichlorohydrin (molecular weight: 1000) in 100 ml of ethanol, the mixture was refluxed for 7 hours. The mixture was cooled to room temperature and the precipitate of sodium chloride was filtered off by suction. The filtrate was concentrated by evaporation until dry to yield 60 g of polymeric compound comprising about 50 mole % of randomly distributed recurring units A and about 50 mole % of randomly distributed recurring units B.

A. 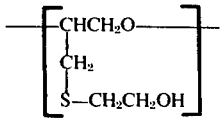

B. 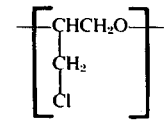

PREPARATION 3

Preparation 2 was repeated with the difference that the reaction partners were used in the following concentrations:

8.6 g of sodium in 250 ml of anhydrous ethanol 29 g of 2-mercaptoethanol 50 g of polyepiclorohydrin (molecular weight: 1000) in 100 ml of ethanol.

Yield: 65 g of polymer comprising about 75 mole % of randomly distributed recurring units A of preparation 2 and about 25 mole % of randomly distributed recurring units B of preparation 2.

PREPARATION 4

Preparation 1 was repeated with the difference that the following reaction partners were used:

24.8 g of sodium in 900 ml of anhydrous ethanol 84.2 g of 2-mercaptoethanol, 100 g of polyepichlorohydrin (molecular weight: 2000 prepared as described in U.S. Pat. No. 2,483,749) in 600 ml of anhydrous ethanol.

Yield: 136 g of polymer having about 100 mole % of recurring units of preparation 1.

PREPARATION 5

To a solution of 23 g of sodium in 600 ml of anhydrous ethanol, 110 g of phenylmercaptan were added at room temperature. After the addition of a solution of 93 g of polyepichlorohydrin (molecular weight: 2000) in 200 ml of ethanol, the reaction mixture was refluxed for 16 hours and 2 layers formed. By the addition of acetone, a white precipitate of sodium chloride was formed which was filtered off by suction. The filtrate was concentrated by evaporation until dry to yield 159 g of polymeric compound having about 100 mole % of recurring units corresponding to the formula:

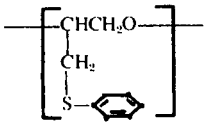

A. 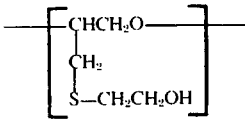

PREPARATION 6

To a solution of 24.8 g of sodium in 400 ml of anhydrous ethanol, 134 g of benzyl mercaptan were added at room temperature. After the addition of a solution of 100 g of polyepichlorohydrin (molecular weight: 2000) in 200 ml of ethanol, the reaction mixture was refluxed for 14 hours. The viscous product formed was dissolved in acetone and the white precipitate was filtered off by suction. The filtrate was concentrated by evaporation until dry to yield 167 g of polymeric compound having about 100 mole % of recurring units of the formula:

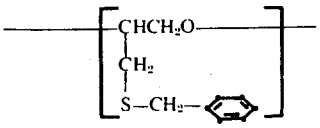

PREPARATION 7

To a solution of 23 g of sodium in 500 ml of anhydrous ethanol, 90 g of n-butylmercaptan were added at room temperature. After the addition of a solution of 93 g of polyepichlorohydrin (molecular weight: 2000) in 200 ml of ethanol, the reaction mixture was refluxed for 16 hours. The viscous product formed became solid by addition of acetone and ether. This white precipitate of sodium chloride was filtered off by suction and the filtrate was concentrated by evaporation until dry to yield 130 g of polymeric compound having about 100 mole % of recurring units of the formula:

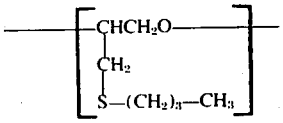

PREPARATION 8

To a solution of 35.5 g of the compound of preparation 1 in 200 ml of anhydrous toluene and 100 ml of anhydrous pyridine, 29.2 g of o-sulphobenzoic anhydride dissolved in toluene were added. The reaction mixture was refluxed for 12 hours and a viscous product formed. The mixture was concentrated by evaporation until dry and the residue was dissolved in 1 liter of water by the addition of a solution of 8.45 g of sodium carbonate in 100 ml of water. The solution was filtered and then concentrated by evaporation until dry.

Yield: 60 g of polymeric compound having besides randomly distributed recurring units of the following formula A randomly distributed recurring units of the following formula C.

C. 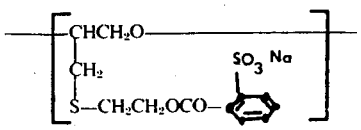

About 50 percent of the hydroxyl groups, including the terminal hydroxyl groups, of the compound of preparation 1 has been esterified by the o-sulphobenzoic anhydride.

PREPARATION 9

Preparation 8 was repeated with the difference that the following reaction partners were used:

67 g of the compound of preparation 4 in 600 ml of anhydrous toluene and 200 ml of anhydrous pyridine, and 23 g of o-sulphobenzoic anhydride dissolved in toluene. Yield: 90 g of polymeric compound with randomly distributed recurring units of the formulae given in preparation 8.

About 25 % of the hydroxyl groups, including the terminal hydroxyl groups of the compound of preparation 4 has been esterified by the o-sulphobenzoic anhydride.

PREPARATION 10

To a solution of 5.7 g of sodium in 200 ml of anhydrous ethanol, a solution of 28.5 g of 2-mercapto-1-methylimidazole in 250 ml of anhydrous ethanol was added at room temperature. After addition of a solution of 46.2 g of polyepichlorohydrin (molecular weight: 2000) in 400 ml of anhydrous ethanol, the reaction mixture was refluxed for 10 hours. The mixture was cooled to room temperature and the sodium chloride was filtered off by suction. The filtrate was concentrated by evaporation until dry. Yield: 65.5 g of polymeric compound having about 50 mole % of randomly distributed recurring units A and about 50 mole % of randomly distributed recurring units B.

A. 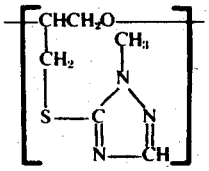

B. 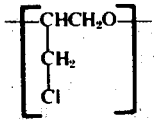

PREPARATION 11

To a solution of 23 g of sodium in 600 ml of anhydrous methanol, 108 g of mercapto glycerin were added at room temperature. After addition of a solution of 92.5 g of polyepichlorohydrin (molecular weight: 2000) in 400 ml of anhydrous methanol, the reaction mixture was refluxed for 24 hours and then cooled. 1 liter of anhydrous ethanol was added and the sodium chloride was filtered off by suction. The filtrate was concentrated by evaporation until dry to yield 165 g of polymeric compound having about 100 mole % of recurring units of the formula:

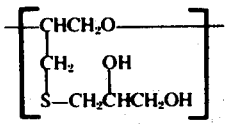

PREPARATION 12

To a solution of 23 g of sodium in 500 ml of anhydrous ethanol, a mixture of 39 g of mercaptoethanol and 54 g of mercaptoglycerin dissolved in 200 ml of anhydrous ethanol was added at room temperature. After addition of a solution of 92.5 g of polyepichlorohydrin (molecular weight: 2000) in 400 ml of anhydrous ethanol the reaction mixture was refluxed for 10 hours and then cooled. The sodium chloride was filtered off by suction and the filtrate concentrated by evaporation until dry. Yield: 153 g of polymeric compound having about 50 mole % of randomly distributed recurring units A and about 50 mole % of randomly distributed recurring units D.

A. 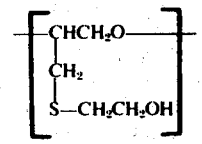

D. 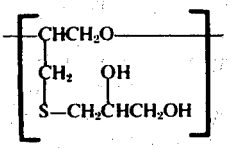

The development accelerators of the present invention may be used in the photographic silver halide material but they are preferably incorporated in the developer composition comprising a black-and-white developing agent e.g. hydroquinone, hydroquinone/1-phenyl-3-pyrazolidinone, hydroquinone/p-monomethylaminophenol sulphate or a colour developing agent more particularly an aromatic primary amino colour developing agent such as a p-phenylene diamine colour developing agent.

The development accelerating compounds can be utilized in various concentrations, depending upon the effects desired, the particular silver halide emulsions employed, the thickness of the emulsion layers, the concentration of silver halides in the emulsions, the concentration of developing agents in the developers, the pH of the developers etc. The optimum amount for any given compound can be determined for any particular emulsion or developer by running a series of tests in which the quantity is varied over a certain range.

In general, useful results are obtained when the concentration of the thioether compound in the developer is from about 10 mg to about 5 g per liter. The activity of the developer will obviously depend upon the temperature of development, which may be room temperature or elevated temperature e.g. above 30°C, upon the duration of development and the like.

When incorporated in the emulsion, the compounds are generally used in concentrations varying from about 10 mg to about 5 g per mole of silver halide. They can be added to the emulsion in no matter what step of emulsion preparation, preferably, however, just before coating.

The thioether compounds can be added to the emulsion or developer using any technique e.g. from a solution or dispersion in a suitable solvent. Of course the solvents used should have no harmful effect on the emulsion and generally solvents which are miscible with water are to be preferred. For example the thioether compounds can be dissolved in water or solvents such as ethanol, acetone, pyridine, N,N-dimethylformamide, dimethyl sulphoxide, N-methylpyrrolidone, etc.

If desired, the thioether compounds of the present invention can be treated with various alkylating agents e.g. the esters of an alcohol and a strong acid such as methyl or ethyl esters of sulphuric acid, phosphoric acid, hydrochloric acid, hydrobromic acid, hydroiodic acid, benzene sulphonic acid, p-toluene sulphonic acid, etc. to convert some or all of the thioether groups into sulphonium groups. By the presence of the units with ternarized sulphonium groups in the side chain, improved solubility in water or various water-miscible solvents is obtained. In general, it suffices to merely heat the thioether compound with the alkylating agent to obtain the desired sulphonium compounds.

The silver halide emulsions which are developed in the presence of the thioether compounds defined above, comprise as light-sensitive silver halide, silver bromide, silver iodide, silver chloride or mixed silver halides such as silver chlorobromide, silver chlorobromoiodide or silver bromoiodide. The emulsions can be chemically sensitized by any of the accepted procedures. The emulsions can be digested with naturally active gelatin or with sulphur-containing compounds such as allyl isothiocyanate, allyl thiourea or sodium thiosulphate. The emulsion can also be digested in the presence of reducing agents e.g. the tin compounds described in Belgian Pat. Specification Nos. 493,464 and 568,687, the iminoaminomethane sulphinic acid compounds described in United Kingdom Patent Specification No. 789,823, polyamines e.g. diethylene triamine, spermine and bis(β-aminoethyl)sulphide. They can further be digested in the presence of noble metal compounds such as ruthenium, rhodium, palladium, iridium, platinum and gold compounds as described by R. Koslowsky, Z. Wiss. Phot. 46, 65–72 (1951). Representative compounds are ammonium chloropalladate, potassium chloroplatinate sodium chloropalladite, potassium chloroaurite, potassium aurithiocyanate, potassium chloroaurate, gold(III) chloride, gold(I) sulphide, etc.

The emulsions can comprise emulsion-stabilizers and fog-inhibiting compounds e.g. the mercury compounds such as those described in Belgian Pat. Specification Nos. 524,121 and 677,337 and in published Dutch Pat. application No. 67/15932, organic sulphur-containing compounds that form insoluble silver salts with silver ions, heterocyclic nitrogen-containing thioxo compounds or derivatives thereof, e.g., benzothiazoline-2-thione, 1-phenyl-2-tetrazoline-5-thione and 2-ethoxycarbonylthio-5-amino-thiadiazole, the compounds described in Belgian Pat. Specification Nos. 571,916 and 571,917, thiazolinium compounds of the type described in Product Licensing Index, December 1971 issue, p. 90–91, benzothiazolium compounds e.g. 2,3-dimethyl-5-methoxycarbonyl benzthiazolium p-toluene sulphonate and tetra- or pentaazaindenes especially those substituted by hydroxyl or amino groups e.g. those described by Birr, Z. Wiss. Phot. 47, 2–58 (1952). A very effective azaindene emulsion stabilizer is 5-methyl-7-hydroxy-s-triazolo[1,5-a]pyrimidine which can be used together with other emulsion stabilizers e.g. those of the type described above.

The emulsions may be X-ray and other non-spectrally sensitized emulsions as well as orthochromatic, panchromatic or infrared-sensitive emulsions. The emulsions may be spectrally sensitized by means of neutrocyanines, carboxycyanines, rhodacyanines, hemicyanines, merocyanines, oxonol dyes, styryl dyes and the like as described by F. M. Hamer in "The cyanine dyes and related compounds" (1954).

The emulsions may further comprise other compounds that sensitize the emulsion by development acceleration e.g. alkylene oxide polymers. These alkylene oxide polymers may be of various type e.g. polyethylene glycol having a molecular weight of 1500 or more, alkylene oxide condensation products or polymers as described in U.S. Pat. Spec. Nos. 1,970,578 - 2,240,472 - 2,423,549 - 2,441,389 - 2,531,832 and 2,533,990 and in United Kingdom Pat. Specification Nos. 920,637 - 940,051 - 945,340 - 991,608 and 1,015,023. These development accelerating compounds may also be present in the silver halide developing solution. Other development accelerating compounds are onium and polyonium compounds preferably of the ammonium, phosphonium and sulphonium type.

Other addenda e.g., hardening agents such as formaldehyde, mucochloric and mucobromic acid, dialdehydes, etc., wetting agents, plasticizers, matting agents, e.g. polymethyl methacrylate and silica particles, light-screening dyes, etc., may be present in the silver halide emulsion or another layer of the light-sensitive materials used according to the invention.

The compounds of the present invention may be used for various kinds of photographic silver halide elements e.g. black-and-white emulsions which include X-ray and lith emulsions and colour emulsions. They may be used in the silver complex diffusion transfer process and in addition to being useful for negative processing they may also be used for reversal processing. In reversal processing whereafter a first black-and-white development residual silver halide is rendered developable by uniform reexposure or by a chemical treatment and then developed by a second development which may be black-and-white or colour, the compounds of the invention are preferably used in the second developer so that development of the residual silver halide rendered developable is activated and thus maximum density is increased.

The thioether compounds of the present invention have been found particularly useful for the development of photographic colour emulsions. They can be used in the production of multicolour images as well as in the production of monochromic images e.g. monochromic radiographic dye images according to the technique described in U.S. Pat. No. 3,734,735 and U.S. Pat. application Ser. No. 210,566 (=published German Pat. application No. 2,165,193).

As is known in the art of silver halide colour photography, dyestuff images are formed by coupling of appropriate colour forming couplers with the oxidation products of aromatic primary amino colour developers particularly p-phenylene diamine colour developing agents. By the presence during the colour development of the novel development accelerators, the maximum density of the dyestuff images as well as the contrast can be increased which results in improved colour saturation. Moreover, in addition to having a favourable development accelerating action, these compounds do not give rise to difficulties in the subsequent bleaching of the silver image as often occurs when using development accelerating onium compounds e.g., quaternary ammonium compounds.

In multilayer photographic elements used in colour photography for the reproduction of multicolour images there are generally three selectively sensitive emulsion layers (each of which may consist of several strata finished to different speed levels) coated on the same side of a photographic support, such as film or paper. Such multilayer elements can also have other layers for special purposes including gelatin or other subbing layers, antihalation layers, protective coatings, etc.

The three selectively sensitive emulsion layers are a blue-sensitive emulsion layer, an emulsion layer sensitized to the green region of the spectrum and an emulsion layer sensitized to the red region of the spectrum. In as much as many photographic silver halide emulsions have an inherent blue sensitivity, the photographic elements generally have a yellow filter layer beneath the blue-sensitive uppermost emulsion layer for the purpose of absorbing substantially all blue radiation which would otherwise be transmitted to the green- and red-sensitized emulsion layers.

Though the invention is primarily concerned with colour materials comprising the colour-forming couplers within the silver halide emulsions, the materials may also be of the type well known in the art and designed for processing in developers which contain the colour forming couplers within the colour developer. The colour-forming couplers are of the customary types employed in colour photography, such as pyrazolone couplers for formation of the magenta image, phenolic or naphtholic couplers for formation of the cyan image and open-chain compounds containing a reactive methylene group for formation of the yellow image.

When the multicolour elements have incorporated colour couplers the blue-sensitive emulsion layer comprises the yellow-forming colour coupler, the green-sensitized emulsion layer comprises the magenta-forming colour coupler and the red-sensitized emulsion layer comprises the cyan-forming colour coupler.

For the incorporation of the colour forming couplers in the silver halide emulsions, the conventional methods can be applied, e.g., they can be incorporated from solutions in high-boiling sparingly water-miscible solvents such as di-n-butyl phthalate and tricresyl phosphate or in low-boiling sparingly water-miscible solvents such as ethyl acetate, methylene chloride and chloroform, etc, or mixtures thereof. For this purpose these solutions are dispersed in extremely fine droplets, preferably in the presence of a wetting or dispersing agent into the hydrophilic colloid medium, the low-boiling sparingly water-miscible solvent then being removed by evaporation. Of course other techniques known by those skilled in the art for incorporating colour couplers, into colloid compositions can be used. For instance, the water-soluble colour couplers i.e., those containing a water-solubilizing sulpho group, in acid or salt form, can be incorporated into the coating composition of the layer in question from an aqueous or alkaline solution.

The hydrophilic colloid composition into which the colour couplers are dispersed or dissolved need not necessarily be the coating composition itself of the silver halide emulsion layer into which the colour couplers are intended to be present. The compounds may advantageously be first dispersed or dissolved in an aqueous non-light-sensitive hydrophilic colloid solution whereupon the resultant mixture after the occasional removal of the organic solvents employed, is intimately mixed with the said coating composition of the light-sensitive silver halide emulsion layer just before coating.

For more details about particularly suitable techniques that may be employed for incorporating colour couplers into a silver halide emulsion layer of a photographic material there can be referred to e.g. U.S. pat. Specification Nos. 2,269,158 - 2,284,887 - 2,304,939 - 2,304,940 and 2,322,027, United Kingdom Pat. Specification Nos. 791,219 - 1,098,594 - 1,099,414 - 1,099,415 - 1,099,416 and 1,099,417, French Pat. Specification No. 1,555,663, Belgian Pat. Specification No. 722,026, German Pat. Specification No. 1,127,714 and to United Kingdom Pat. Application No. 14,763/69.

In the colour development aromatic primary amino developing substances are used, which are capable of forming azomethine dyes by coupling in their oxidized form with the colour-forming couplers. Suitable developing agents are more particularly p-phenylene diamine and derivatives thereof e.g. N,N-dialkyl-p-phenylene diamines, N,N-dialkyl-N-'-sulphomethyl-p-phenylenediamine, N,N-dialkyl-N-'-carboxymethyl-p-phenylenediamine, the sulphonamido substituted p-phenylene diamines disclosed in U.S. Pat. Specification No. 2,548,574 and other substituted p-phenylene diamines disclosed in U.S. Pat. Specification No. 2,566,271.

Typical examples of p-phenylenediamines are N,N-diethyl p-phenylene diamine, 2-amino-5-diethylaminotoluene, N-butyl-N-sulphobutyl-p-phenylene diamine, 2-amino-5-[N-ethyl-N(β-methylsulphonamido)ethyl]aminotoluene, N-ethyl-N-β-hydroxyethyl-p-phenylenediamine, etc. These developing agents are used usually in their salt form such as the hydrochloride or sulphate. Specification The following examples illustrate the present invention.

EXAMPLE 1

A 35 mm strip of a commercially available multicolour reversal film material (Gevachrome Original T 605 film marketed by Agfa-Gevaert N. V., Mortsel, Belgium) was exposed through a grey continuous wedge to white light in a Hernfeld Sensitometer.

The exposed strip was then processed as follows:

treatment for 10 seconds at 25°C in a pre-bath of the following composition:

| | |
|---|---|
| water | 800 ml |
| ethylene diamine tetraacetic acid tetrasodium salt | 2 g |
| anhydrous sodium sulphate | 100 g |
| borax | 15 g |
| water to make | 1000 ml (pH 9.30) |

rinsing for 15 seconds and brushing of the back to remove antihalation layer;

developing for 3 min. 45 sec. at 25°C in a black-and-white developer of the following composition:

| | |
|---|---|
| N-methyl-p-aminophenol sulphate | 3 g |
| hydroquinone | 6 g |
| sodium metabisulphite | 0.5 g |
| sodium hexametaphosphate | 2 g |
| sodium sulphite | 50 g |
| anhydrous sodium carbonate | 40 g |
| potassium bromide | 2.3 g |
| potassium thiocyanate | 2.5 g |
| potassium iodide | 6 mg |
| water to make | 1000 ml (PH 10.2) |

treatment for 2 minutes in a stop bath of the following composition:

| | |
|---|---|
| potassium alum | 15 g |
| boric acid | 6 g |
| sodium hydrogen diacetate | 15 g |
| sodium metabisulphite | 1 g |
| water to make | 1000 ml (pH 4.2) |

rinsing with water for 3 minutes and overall re-exposing the material for 1 minute at 25°C;

colour developing for 4 minutes at 25°C in a colour developer of the following composition:

| | |
|---|---|
| sodium hexametaphosphate | 1 g |
| sodium sulphite | 4 g |
| anhydrous sodium carbonate | 25 g |
| potassium bromide | 2.2 g |
| sodium hydroxide | 0.6 g |
| hydroxylamine hydrochloride | 1.2 g |
| N,N-diethyl-p-phenylene diamine hydrochloride | 2.7 g |
| potassium iodide | 4 mg |
| water to make | 1000 ml (pH 10.7) |

rinsing with water for 10 sec. at 25°C;

fixing for 3 minutes at 25°C in the following fixing solution:

| | |
|---|---|
| potassium alum | 15 g |

-continued

| | |
|---|---|
| acid sodium sulphate | 13 g |
| sodium acetate trihydrate | 25 g |
| sodium bisulphite | 12 g |
| sodium thiosulphate | 200 g |
| water to make | 1000 ml (pH 3.9) |

rinsing with water for 2 min. at 25°C;

silver bleaching for 4 min. at 25°C in the following bleach bath:

| | |
|---|---|
| potassium bromide | 15 g |
| potassium alum | 45 g |
| acid potassium sulphate | 2 g |
| sodium acetate trihydrate | 5 g |
| sodium hydrogen diacetate | 10 g |
| potassium hexacyanoferrate (III) | 75 g |
| water to make | 1000 ml (pH 3.9) |

rinsing with water for 3 min. at 25°C, treating for 3 min. at 25°C in the above fixing solution, rinsing with water for 5 min. at 25°C, and stabilizing for 8 sec. at 25°C in a stabilizing bath comprising per liter 13 ml of a 40% aqueous formaldehyde solution and a wetting agent.

A second strip of the above 35 mm reversal colour film was exposed and processed under identical circumstances as the first strip, with the only difference that the colour developer now also contained per liter 100 mg of the polymeric compound of preparation 1.

In the following table the values are given which were obtained for maximum density and gradation. The values given for the gradation are the average gradients of the characteristic curve measured over an exposure range of $\Delta$ log It = 1.20 beginning at the point corresponding to density 0.20 above fog.

Table

| Strip | $D_{max}$ blue | green | red | Gradation blue | green | red |
|---|---|---|---|---|---|---|
| strip 1 | 1.72 | 1.70 | 1.79 | 0.98 | 0.85 | 0.95 |
| strip 2 | 2.61 | 2.96 | 3.02 | 1.34 | 1.35 | 1.21 |

The above results show that when colour development takes place in the presence of a compound according to the present invention, higher contrast and higher maximum density are obtained. The selectivity of colour reproduction is also favourable.

The same favourable results could be obtained with the compound of preparation 4.

EXAMPLE 2

A A of of a commercially available multicolour film material (Gevacolor Negative - type 6.55 marketed by Agfa-Gevaert N. V., Mortsel, Belgium) was exposed for 1/20 sec. through a continuous wedge with constant 0.20 to white light in a Hernfeld sensitometer.

The exposed strip was then processed at 24°C as follows:

treatment for 10 seconds in the pre-bath of example 1, developing for a time as given in the table below in a colour developing bath of the composition given in example 1, rinsing with water for 10 sec., fixing for 2 minutes in the fixing solution of example 1, rinsing with water for 1 minute, silver bleaching for 3 minutes in a bath of the following composition:

| | |
|---|---|
| water | 800 ml |
| potassium hexacyanoferrate | 50 g |
| potassium bromide | 15 g |
| borax | 20 g |
| sodium bisulphate | 4.2 g |
| water to make | 1000 ml (pH 8.80) |

rinsing with water for 2 minutes, treating again with the fixing solution of example 1 for 2 minutes, rinsing with water for 4 minutes, and treating for 10 seconds, in the stabilizing solution of example 1.

Strips B and C of the same multicolour film material were exposed and processed under identical circumstances as strip A, with the only difference that the colour developer for strip B now also contained per liter 100 mg of the polymeric compound of preparation 1 and that the colour developer for strip C now also contained per liter 100 mg of the polymeric compound of preparation 3.

The values obtained for speed and gradation are listed in the table below. The values given for the speed measured at density 0.2 above fog are relative values, a speed of 100 being given to the blue sensitive, green sensitive and red sensitive emulsion layers of strip A. The values given for the gradation are the average gradients of the characteristic curves measured over an exposure range of $\Delta$ log It = 0.8 beginning at the point corresponding to density 0.20 above fog.

Table

| Strip | Development time | Speed blue | green | red | Gradation blue | green | red |
|---|---|---|---|---|---|---|---|
| A | | 100 | 100 | 100 | 0.48 | 0.55 | 0.48 |
| B | 4 min. | 162 | 371 | 126 | 0.66 | 0.45 | 0.49 |
| C | | 182 | 316 | 138 | 0.76 | 0.52 | 0.52 |
| A | | 100 | 100 | 100 | 0.60 | 0.64 | 0.58 |
| B | 6 min. | 115 | 240 | 117 | 0.91 | 0.52 | 0.55 |
| C | | 148 | 282 | 138 | 1.04 | 0.57 | 0.59 |

The above results show the favourable effect of the thioether compounds of the invention on the gradation and speed. They are particularly effective in increasing the gradation of the blue-sensitive layer and the speed of the green-sensitive layer.

EXAMPLE 3

A strip A of a commercially available multicolour film material (Gevacolor Positive cine type 9.85 marketed by Agfa-Gevaert N. V., Mortsel, Belgium) was exposed for 1/20 second through a continuous wedge with constant 0.15, to white light in a Hernfeld II sensitometer.

The exposed strip was then processed as follows:

treatment for 10 seconds at 24°C in the pre-bath of example 1, developing for 7 minutes at 24°C in a colour developing bath of the following composition:

| | |
|---|---|
| sodium hexametaphosphate | 2 g |
| anhydrous sodium sulphite | 4 g |
| anhydrous sodium carbonate | 17 g |
| potassium bromide | 2 g |
| 2-amino-5-diethylaminotoluene | |

-continued

| | |
|---|---|
| hydrochloride | 3 g |
| water to make | 1000 ml (pH 10.65) |

fixing for 5 minutes at 24°C in the fixing bath of example 1, rinsing with water for 10 minutes at 15°C, silver bleaching for 8 min. at 20°C in the following bleach bath:

| | |
|---|---|
| potassium bromide | 20 g |
| potassium dichromate | 5 g |
| potassium alum | 40 g |
| water to make | 1000 ml (pH 3.1) |

rinsing with water for 5 minutes at 150°C, treating again for 5 minutes at 25°C in the fixing bath of example 1, rinsing with water at 15°C, and stabilizing for 20 seconds in the stabilizing bath of example 1.

Strips B and C of the same multicolour film material were exposed and processed under identical circumstances as strip A, with the only difference that the colour developer for strip B now also contained per liter 100 mg of the polymeric compound of preparation 1, and that the colour developer for strip C now also contained per liter 100 mg of the polymeric compound of preparation 3.

The sensitometric values obtained are listed in the following table. The values of the speed measured at density 1.10 are relative values, a speed of 100 being given to the emulsion layers of strip A. The values given for the gradation are the average gradients of the characteristic curves measured over an exposure range of $\Delta$ log It = 0.45 beginning at the point corresponding to density 1.10.

Table

| Strip | Fog blue | Fog green | Fog red | Speed blue | Speed green | Speed red | Gradation blue | Gradation green | Gradation red |
|---|---|---|---|---|---|---|---|---|---|
| A | 0.09 | 0.07 | 0.05 | 100 | 100 | 100 | 2.35 | 3.10 | 3.51 |
| B | 0.14 | 0.17 | 0.12 | 245 | 219 | 235 | 2.85 | >5 | >5 |
| C | 0.13 | 0.13 | 0.07 | 240 | 200 | 191 | 3.25 | >5 | >5 |

EXAMPLE 4

A radiographic silver halide colour material having at both sides of a polyethylene terephthalate support a silver halide emulsion of the type described and claimed in U.S. Pat. application Ser. No. 210,566 (published German Pat. application No. 2,165,193) which is composed of a mixture of a high speed silver bromoiodide emulsion (9 mole % of AgI) and a low speed silver chloride emulsion, the ratio of silver bromoiodide to silver chloride corresponding to 95:5 in parts by weight of silver nitrate, and which comprises a colour coupler of the formula:

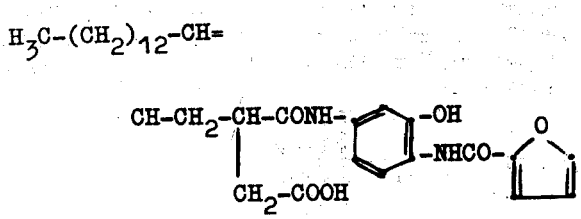

was divided into several strips.

The strips were exposed to light through a wedge and colour-developed for 35 sec. at 37°C in a developer comprising per liter : 8 g of N-hydroxyethyl-N-ethyl-p-phenylenediamine, 1.5 g of hydroxylamine, 4 g of anhydrous sodium sulphite, 1 g of potassium bromide, an antifoggant such as 5-nitrobenzimidazole, 65 g of anhydrous potassium carbonate, and an amount of thioether compound according to preparation 1 as listed in the table below. After development, the strips were fixed in a conventional sodium thiosulphate fixing solution.

The coloured photographic wedge prints obtained were measured by means of a colour densitometer provided with red filter. The values of the speed, measured at density 1.0 above fog are relative values. The values given for the gradation are the average gradients of the characteristic curves measured between density 0.25 above fog and density 2.00 above fog.

Table

| mg of compound according to preparation 1 per liter of developer | Fog | Relative Speed | Gradation |
|---|---|---|---|
| — | 0.14 | 100 | 2.61 |
| 100 mg | 0.15 | 126 | 2.93 |
| 200 mg | 0.18 | 145 | 3.09 |

EXAMPLE 5

This example is completely analogous to example 1, with the only difference that colour development occurred for 7 min. 30 sec. instead of 4 min. and that the colour developing composition for strip 2 now comprised per liter 1.5 g of the compound of preparation 8.

The results attained were as follows:

| Strip | $D_{max}$ blue | $D_{max}$ green | $D_{max}$ red | Gradation blue | Gradation green | Gradation red |
|---|---|---|---|---|---|---|
| strip 1 | 2.90 | 2.52 | 3.03 | 1.66 | 1.41 | 1.50 |
| strip 2 | 3.10 | 2.88 | 3.30 | 1.80 | 1.55 | 1.75 |

EXAMPLE 6

Three strips of a material as described in Example 1 were exposed through a grey continuous wedge to white light in a Hernfeld Sensitometer.

The exposed strip 1 was processed as described in Example 1 for strip 1. Strips 2 and 3 were processed in the same way with the only difference that to the black-and-white developer of example 1 were added per liter: 100 mg of the compound of preparation 1 (strip 2) and 100 mg of the compound of preparation 1 plus 3 g of polyethylene glycol having an average molecular weight of 1000 (strip 3).

The sensitometric results attained are listed in the following table. The values given for the speed (measured at density 1), are relative values; a value of 100 is given for the speed of strip 1. The values given for the gradation are the average gradients of the characteristic curve measured over an exposure range of Δ log It = 0.60 beginning at the point corresponding to density 0.70 above fog.

Table

| Strip | Maximum density blue | green | red | Speed blue | green | red | Gradation blue | green | red |
|---|---|---|---|---|---|---|---|---|---|
| 1 | 3.5 | 3.13 | 3.50 | 100 | 100 | 100 | 3.85 | 3.00 | 4.25 |
| 2 | 1.70 | 2.46 | 3.48 | 245 | 166 | 117 | 1.90 | 2.70 | 4.92 |
| 3 | 1.87 | 2.38 | 3.43 | 234 | 195 | 155 | 2.75 | 2.87 | 5.12 |

EXAMPLE 7

In this example a photographic X-ray material was used which comprises a polyethylene terephthalate support carrying at both sides of the support a light-sensitive layer coated from an emulsion comprising per kg an amount of silver halide corresponding to 190 g of silver nitrate, 74 g of gelatin, 545 mg of 5-methyl-7-hydroxy-s-triazolo[1,5-a]pyrimidine, 6.5 mg of 1-phenyl-5-mercapto-tetrazole and 0.45 mg of mercury cyanide.

A strip I of the material was exposed through a continuous wedge and then developed for 4 min. at 20°C in a bath of the following composition:

| | |
|---|---|
| ethylene diamine tetraacetic acid trisodium salt | 1 g |
| 40% by weight of aqueous potassium hydroxide | 60 ml |
| potassium metabisulphite | 35 g |
| hydroquinone | 10 g |
| 1-phenyl-3-pyrazolidinone | 0.5 g |
| potassium carbonate (anhydrous) | 15 g |
| potassium bromide | 2 g |
| 1-phenyl-5-mercaptotetrazole | 20 mg |
| water to make | 1 liter. |

Another strip II was exposed and developed in the same way with the only difference that 200 mg of the compound of preparation 1 was added to the developer.

The following sensitometric results were attained. The values given for the speed, measured at density 1, are relative values.

| Strip | Fog | Speed | Gamma | $D_{max}$ |
|---|---|---|---|---|
| I | 0.21 | 100 | 3.63 | 3.10 |
| II | 0.22 | 182 | 3.30 | 3.18 |

EXAMPLE 8

Strips of a commercially available black-and-white reversal film material (Gevapan 36 Reversal Type 8.80 marketed by Agfa-Gevaert N. V., Mortsel, Belgium) was exposed through a grey continuous wedge to white light in a sensitometer.

Strip I was developed for 2 min. at 20°C in the developer composition given below whereas strip II was developed in the same, with the only difference that 200 mg of the compound of preparation 1 was added to the developer.

| Developer | |
|---|---|
| ethylene diamine tetraacetic acid trisodium salt | 2 g |
| N-methyl-p-aminophenol sulfate | 0.6 g |
| sodium sulphite (anhydrous) | 50 g |

-continued

| | |
|---|---|
| hydroquinone | 20 g |
| potassium bromide | 8 g |
| sodium hydroxide | 20 g |
| potassium thiocyanate | 7.2 g |
| water to make | 1 liter. |

The strips were then further processed at 20°C as follows: 1 min. rinsing, 1 min. bleaching, 1 min. rinsing, 1 min. clearing, 1 min. rinsing, overall reexposing, 1 min. developing, 1 min. rinsing, 1 min. fixing and 2 min. rinsing. The baths used had the following compositions:

| | |
|---|---|
| Bleaching bath | |
| potassium bichromate | 10 g |
| concentrated sulphuric acid | 12 ml |
| water to make | 1 liter |
| Developing bath | |
| ethylene diamine tetraacetic acid trisodium salt | 1 g |
| N-methyl-p-aminophenol sulphate | 1 g |
| sodium sulphite (anhydrous) | 50 g |
| hydroquinone | 20 g |
| potassium bromide | 5 g |
| potassium iodide | 0.250 g |
| sodium hydroxide | 15 g |
| water to make | 1 liter |
| Clearing bath | |
| ethylene diamine tetraacetic acid trisodium salt | 1 g |
| sodium sulphite (anhydrous) | 100 g |
| water to make | 1 liter |
| Fixing bath | |
| sodium thiosulphate (anhydrous) | 200 g |
| sodium sulphite (anhydrous) | 10 g |
| boric acid | 6 g |
| glacial acetic acid | 10 ml |
| potassium alum | 20 g |
| water to make | 1 liter. |

The sensitometric values obtained were as follows. The values given for the speed, measured at density 1, are relative values.

| Strip | Fog | Speed | Gamma |
|---|---|---|---|
| I | 0.08 | 100 | 1.20 |
| II | 0.08 | 269 | 1.03 |

We claim:

1. A method of developing a photographic element containing developable silver halide, said method including having a polyoxyethylene compound present in the element or in the developer bath during development, said polyoxyethylene compound comprising from about 20 to 100 mole percent recurring units of the formula:

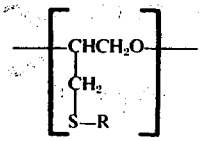

and 80 to 0 mole percent recurring units of the formula:

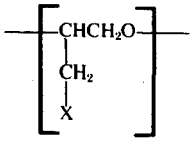

wherein R represents an aliphatic, aromatic, or heterocyclic group, and X is halogen.

2. Method according to claim 1 wherein R is alkyl or hydroxyalkyl.

3. Method according to claim 1 wherein the said compound is present in the aqueous alkaline solution used to effect development.

4. Method according to claim 1, wherein the said compound is present in the aqueous alkaline developing solution in an amount from about 10 mg and about 1 g per liter.

5. Method according to claim 1, wherein the photographic element is a photographic colour element.

6. Method according to claim 5, wherein the photographic colour element incorporates colour forming couplers capable of coupling with the oxidation products of a colour developing agent to form dyestuff images.

7. Method according to claim 6, wherein the photographic colour element is a multicolour element comprising a blue-sensitive emulsion layer with yellow-forming colour coupler, a green-sensitized emulsion layer wth magenta-forming colour coupler and a red-sensitized emulsion layer with cyan-forming colour coupler.

8. A photographic developer comprising a silver halide developing agent and a polyoxyethylene compound comprising from about 20 to 100 mole percent recurring units of the formula:

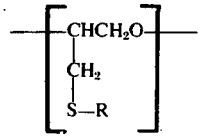

and 80 to 0 mole percent recurring units of the formula:

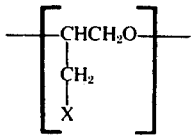

wherein R represents an aliphatic, aromatic or heterocyclic group, and X is halogen.

9. A photographic developer according to claim 8, wherein R is alkyl or hydroxyalkyl.

10. A photographic developer according to claim 8, wherein the developing agent is a black-and-white developing agent.

11. A photographic developer according to claim 8, wherein the developing agent is an aromatic primary amino colour developing agent.

12. A photographic developer according to claim 8, wherein the developing agent is a p-phenylene diamine colour developing agent.

13. A photographic developer according to claim 8, wherein the said compound is present in an amount comprised between about 10 mg and about 1 g per liter.

14. A photographic element comprising at least one silver halide emulsion layer wherein the emulsion layer contains a polyoxyethylene compound comprising from about 20 to 100 mole percent recurring units of the formula:

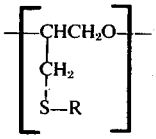

and 80 to 0 mole percent recurring units of the formula:

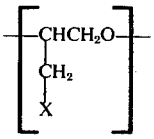

wherein R represents an aliphatic, aromatic or heterocyclic group, and X is halogen.

15. A photographic element according to claim 14, wherein R is alkyl or hydroxyalkyl.

16. A photographic element according to claim 14, wherein the emulsion comprises a colour coupler.

17. Method according to claim 1, wherein R is selected from the group consisting of alkyl, aralkyl, hydroxyalkyl, alkoxyalkyl, alkylthioalkyl, acyloxyalkyl, cycloalkyl, aryl.

18. Method according to claim 2, wherein alkyl has from 1 to 5 carbon atoms.

19. A photographic developer according to claim 8, wherein R is selected from the group consisting of alkyl, aralkyl, hydroxyalkyl, alkoxyalkyl, alkylthioalkyl, acyloxyalkyl, cycloalkyl, aryl.

20. A photographic developer according to claim 9, wherein alkyl has from 1 to 5 carbon atoms.

21. A photographic element according to claim 14, wherein R is selected from the group consisting of alkyl, aralkyl, hydroxyalkyl, alkoxyalkyl, alkylthioalkyl, acyloxyalkyl, cycloalkyl, aryl.

22. A photographic element according to claim 15, wherein alkyl has from 1 to 5 carbon atoms.

* * * * *